US006769934B2

(12) United States Patent
Nakamura et al.

(10) Patent No.: US 6,769,934 B2
(45) Date of Patent: Aug. 3, 2004

(54) CONNECTOR AND AN UNLOCKING JIG THEREFOR

(75) Inventors: Hideto Nakamura, Yokkaichi (JP); Takeshi Tsuji, Yokkaichi (JP); Ryotaro Ishikawa, Yokkaichi (JP); Hajime Kawase, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 16 days.

(21) Appl. No.: 10/175,235

(22) Filed: Jun. 18, 2002

(65) Prior Publication Data

US 2003/0060075 A1 Mar. 27, 2003

(30) Foreign Application Priority Data

| | | |
|---|---|---|
| Jun. 18, 2001 | (JP) | 2001-183823 |
| Aug. 10, 2001 | (JP) | 2001-244293 |
| Feb. 1, 2002 | (JP) | 2002-025192 |
| Mar. 4, 2002 | (JP) | 2002-057689 |

(51) Int. Cl.[7] ..... H01R 13/40
(52) U.S. Cl. ..... 439/595
(58) Field of Search ..... 439/595, 603, 439/752, 345

(56) References Cited

U.S. PATENT DOCUMENTS

| | | | | |
|---|---|---|---|---|
| 3,641,477 A | * | 2/1972 | Plana | 439/595 |
| RE27,463 E | * | 8/1972 | Sitzler et al. | 439/595 |
| 4,889,501 A | * | 12/1989 | Sato | 439/595 |
| 4,969,841 A | * | 11/1990 | Sueyoshi et al. | 439/595 |
| 4,979,912 A | * | 12/1990 | Shindo et al. | 439/595 |
| 5,066,252 A | * | 11/1991 | Kato et al. | 439/595 |
| 5,607,327 A | * | 3/1997 | Tsuji et al. | 439/595 |
| 5,755,600 A | | 5/1998 | Yoshida | |
| 5,839,921 A | | 11/1998 | Yamanashi | |
| 5,860,835 A | * | 1/1999 | Ohsumi | 439/595 |
| 5,980,318 A | | 11/1999 | Morello et al. | |

FOREIGN PATENT DOCUMENTS

| | | |
|---|---|---|
| JP | 6-325814 | 11/1994 |
| JP | 8-222321 | 8/1996 |

* cited by examiner

*Primary Examiner*—Javid H Nasri
(74) *Attorney, Agent, or Firm*—Gerald E. Hespos; Anthony J. Casella

(57) ABSTRACT

Cavities (21) into which terminal fittings (10) are insertable from behind are arranged at upper and lower stages in a housing (20), and locks (28) are provided at the lower surfaces of the respective cavities (21). Each lock (28) is formed by cutting a partition wall (22) partitioning the upper and lower cavities (21) or a bottom wall (23) of the housing (20), and includes an arm (29) supported at both front and rear ends. A locking section (30) engageable with an engaging edge (15) of the corresponding terminal fitting (10) is provided on the upper surface of each arm portion (29) to project into the cavity (21). When the terminal fitting (10) is inserted into the cavity (21), the locking section (30) is pushed by the terminal fitting (10) to resiliently deform the arm (29) into a substantially arched shape with its coupled portions at the front and rear ends as supporting points.

26 Claims, 16 Drawing Sheets

CONNECTOR AND AN UNLOCKING JIG THEREFOR

BACKGROUND OF THE INVENTION

1. Field of the Invention

The invention relates to a connector with locks for locking terminal fittings and to an unlocking jig for unlocking the terminal fittings.

2. Description of the Related Art

Japanese Unexamined Patent Publication No. 6-325814 and FIG. 17 herein disclose a connector with a housing identified by the numeral 1 in FIG. 17. Terminal fittings 2 are inserted into cavities 3 in the housing 1. Deformation permitting spaces 4 and locks 5 are formed adjacent ceiling surfaces of the cavities 3. The locks 5 deform into the deformation permitting spaces 4 in response to pushing forces exerted as the terminal fittings 2 are inserted. The locks 5 then are restored resiliently to lock the terminal fittings 2 when the terminal fittings 2 are inserted to proper depth. Each lock 5 has an arm 6 supported at one end and projecting forward. A locking section 7 is provided on the inner surface of the arm 6 and projects into the cavity 3 for engaging the terminal fitting 2. A projection 8 projects forward from the leading end of the arm 6 and can be maneuvered to unlock the terminal fitting 2.

The connector of FIG. 17 could be made smaller by thinning the arms 6 of the locks 5. However, the arms 6 are supported only at one end, and a specified thickness must be ensured to obtain necessary strength. Therefore, there has been a limit in making the connector smaller by thinning the arms 6.

Japanese Unexamined Patent Publication No. 8-222321 and FIG. 18 herein disclose a connector with a housing identified by the numeral 1' in FIG. 18. A terminal fitting 2' is inserted into a cavity 3' formed in a connector housing 1'. The terminal fitting 2' has a stabilizer 4' that is inserted into an insertion groove 5' at a lateral edge of the bottom surface of the cavity 3' to guide the terminal fitting 2' into the cavity 3'. A lock 6' is cantilevered from the bottom surface of the cavity 3' and the free end of the lock 6' is deformed as the terminal fitting 2' is inserted into the cavity 3'. When the terminal fitting 2' is inserted to proper depth, the stabilizer 4' is located at the side of the lock 6' and the lock 6' is restored resiliently to engage and lock the terminal fitting 2'.

The lock 6' and the insertion groove 5' overlap longitudinally and the insertion groove 5' cuts off the lateral edge of the lock 6'. Thus, the width of the lock 6' is smaller by the width of the insertion groove 5' and a ratio of the width of the lock 6' to that of the cavity 3' is smaller. The minimum width of the cavity 3' equals the minimum width of the lock 6' that is needed to ensure necessary strength plus the width of the insertion groove 5'. Therefore, there has been a limit in making the connector smaller.

The present invention was developed in view of the above problem and an object thereof is to make a connector smaller.

SUMMARY OF THE INVENTION

The invention relates to a connector with a housing that has at least one cavity into which at least one terminal fitting is insertable. A resiliently deflectable lock is formed on an inner surface of each cavity and is supported at its opposite ends. The terminal fitting pushes and deforms the lock as the terminal fitting is inserted into the cavity. However, the lock is restored resiliently to lock the terminal fitting that has been inserted sufficiently.

The support at both ends of each lock ensures a high strength even if the locks are thinned, as compared to conventional cantilevered locks. Thus, the connector can be made small without degrading the strength of the locks.

Each lock may define an outer wall of the housing or a partition wall between cavities. Thus, the connector can be made smaller. Further, since the lock is supported at both ends, the terminal fitting inserted into the cavity is supported firmly. In addition, a conventional cantilevered lock that functioned as an outer wall or a partition wall would expose the terminal fitting adjacent the free end of the lock. However, the lock supported at both ends provides enhanced protection because an exposed area of the terminal fitting is smaller.

Each lock preferably comprises a maneuverable recess to permit the lock to be maneuvered by an unlocking jig from outside. The maneuverable recess enables the connector to be made smaller, as compared to a maneuverable projection formed on a lock.

The lock preferably is substantially parallel with a terminal insertion direction of the terminal fitting into the cavity.

The lock preferably comprises a locking section for engaging the terminal fitting, and the lock preferably is displaced by a distance substantially corresponding to the projecting distance of the locking section.

The lock preferably is formed such that a terminal fitting contacts the housing over substantially its entire length during insertion of the terminal fitting into the cavity. Accordingly, the terminal fitting is held stably in the cavity.

An end of each lock preferably is integral or unitary with a front wall of the housing. Additionally, each maneuverable recess preferably opens forwardly and forms a fork at the front end of the lock. The maneuverable recess preferably has an introduction opening into which the unlocking jig is loosely insertable, and a guide surface is formed at the rear of the introduction opening to guide the jig toward the rear of the maneuverable recess. The jig can be inserted loosely through the introduction opening at an initial state of inserting the jig into the maneuverable recess. Thereafter, the unlocking jig is guided by the guide surface into a position where the jig can push the peripheral edge of the maneuverable recess. Thus, operability is good.

Further, since the lock is forked or divided to form the introduction opening, a maximum opening area of the introduction opening can be ensured in relation to the thickness of the lock.

The maneuverable recesses are open in the front wall of the housing. Insertion holes also open in the front wall of the housing to permit insertion of mating terminal fittings into the cavities. The unlocking jig is formed with a detector that interferes with the edge of the insertion hole to prevent a mistaken insertion of the unlocking jig into the insertion hole. However, the front wall is formed with a receiving portion adjacent each maneuverable recess. The receiving portion is dimensioned to receive the detector, and hence permits insertion of the unlocking jig into the maneuverable recess. Thus, an erroneous insertion of the jig into the insertion hole can be detected, and operability of detaching the terminal fitting with the unlocking jig can be improved.

The above-described fork at the front end of each lock makes the front end of the respective lock less rigid. However, the front end of the lock does not contribute significantly to the strength for locking the terminal fitting.

Additionally, the fork makes the front end of the lock more likely to deform. Thus, resistance during the insertion of the terminal fitting is lower, while a sufficient force for holding the terminal fittings is ensured.

The fork of the lock is supported on the front wall of the cavity. Thus, the lock is longer than a lock supported on a side wall of the cavity and a degree of freedom in designing the lock can be improved.

The maneuverable recess for disengaging the lock from the terminal fitting utilizes the groove defined by the fork. Hence, an even simpler construction can be realized.

Insertion grooves may be formed in side surfaces of the cavities that have the locks, and stabilizers may project from the terminal fittings for insertion laterally in the insertion grooves. The locks and the insertion grooves are spaced from each other along a terminal insertion direction, but overlap with respect to the width. Thus, unlike the prior art, the locks are not cut or weakened by the insertion grooves and a large ratio of the width of the locks to the width of the cavities can be ensured. Accordingly, the cavities can be narrow when the locks are set at a minimum width that ensures sufficient strength, and therefore, the connector can be made smaller.

The stabilizer and the insertion groove cooperate to guide the inserting movement of the terminal fitting and ensure that the terminal fitting deforms the lock properly. The lock is restored resiliently and locks the terminal fitting when the terminal fitting is inserted substantially to the proper depth.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to a first embodiment of the invention is shown in FIGS. 1–10. The connector has terminal fittings 10 that can be accommodated in a housing 20, and a retainer 40 for locking the terminal fittings 10. The inserting direction ID of the terminal fittings 10 into the housing 20 is referred to herein as a forward direction, and reference is made to the drawings except FIGS. 3 and 6 for the vertical direction.

Figure 4:
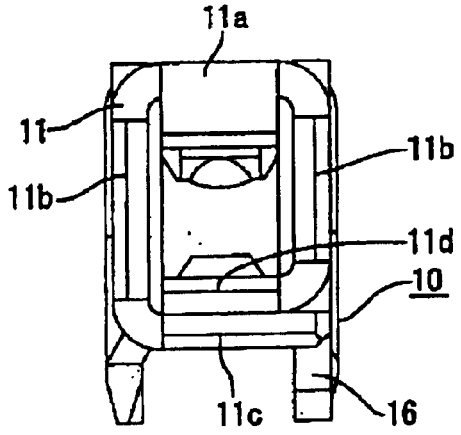
FIG. 4 is a front view of a terminal fitting.
Figure 5:
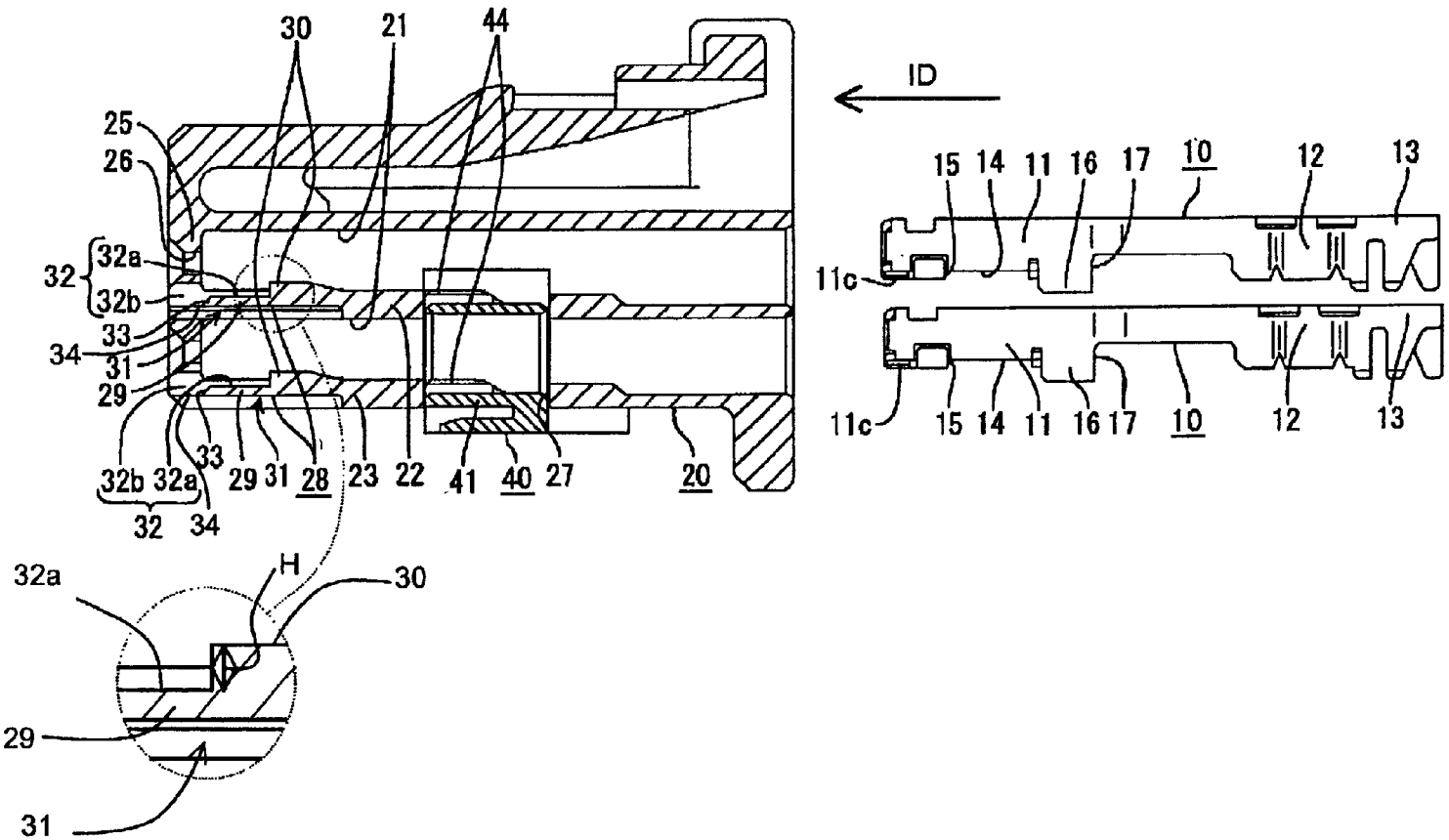
FIG. 5 is a side view in section showing the housing having the retainer mounted at a partial locking position and terminal fittings.

As shown in FIG. 5, each terminal fitting 10 is formed by bending and/or embossing a metallic plate stamped or cut into a specified shape. The terminal fitting 10 has a main portion 11 that extends rearwardly from the front end. The main portion 11 is configured for electrical connection with a mating male terminal. An insulation-displacement portion 12 is formed rearward of the main portion 11 and is configured to be connected with a wire (not shown) by insulation displacement. A barrel portion 13 is adjacent the rear end and is configured for crimped connection with the wire W. As shown in FIG. 4, the main portion 11 has a substantially box shape that is open forward and backward and has a base wall 11*a*, side walls 11*b* that extend up from opposite side edges of the base wall 11*a* and overlapped outer and inner projecting pieces 11*c*, 11*d* that extend from top edges of the side walls 11*b*. The outer projecting piece 11*c* has a middle portion cut away over a specified length to form an escaping portion 14 that has a front edge 15. A stabilizer 16 projects down from a rear part of the inner projecting piece 11*d*. A jaw 17 is provided at a bottom of the rear end of the main portion 11, and is substantially flush with the rear of the stabilizer 16.

Figure 1:
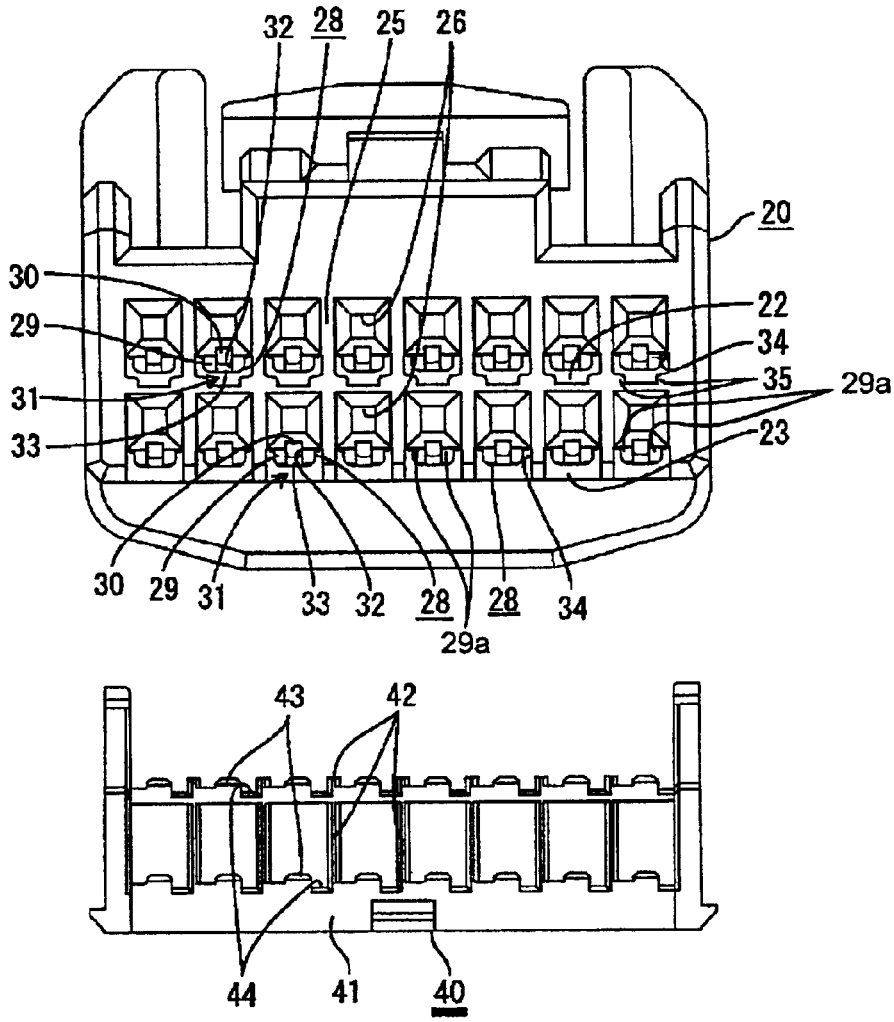
FIG. 1 is a front view of a housing and a retainer according to one embodiment of the invention.
Figure 2:
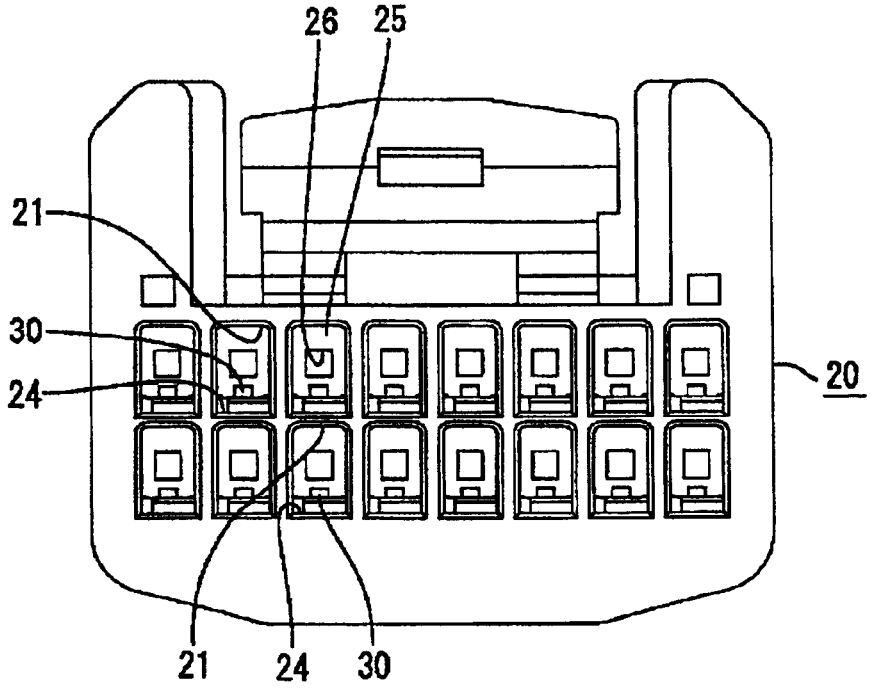
FIG. 2 is a rear view of the housing.
Figure 6:
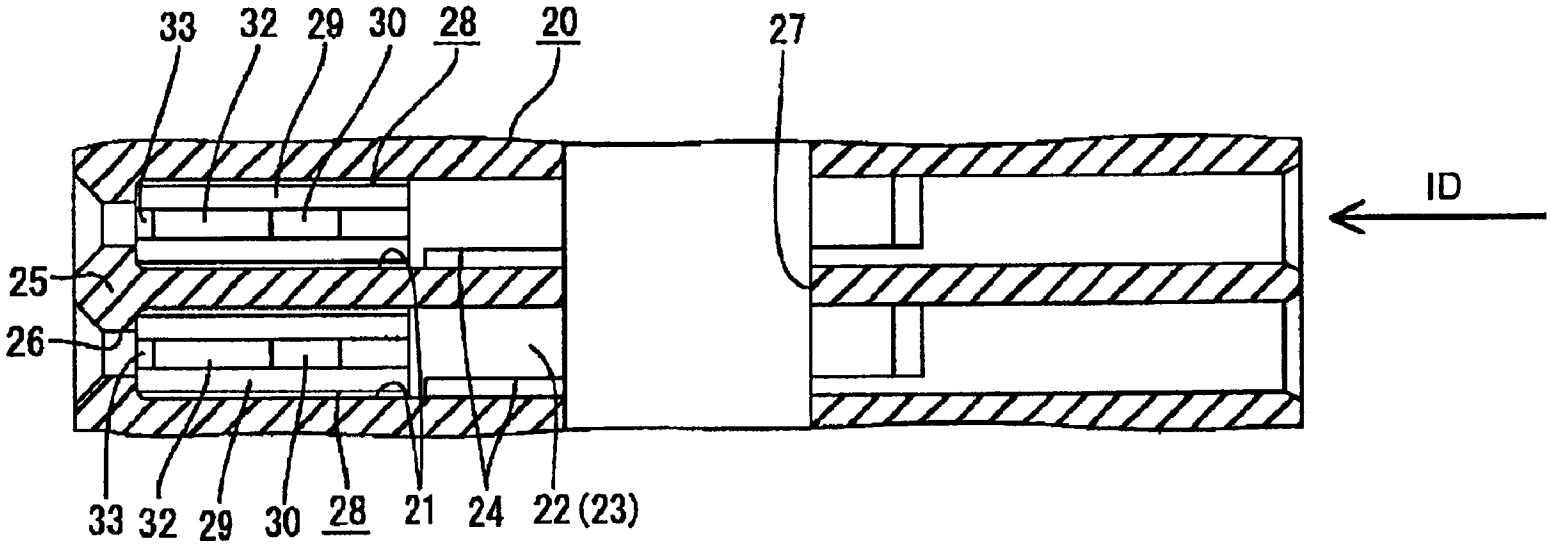
FIG. 6 is plan view in section of the housing.

As shown in FIG. 1, the housing 20 is made e.g. of a synthetic resin and has a substantially block shape. Cavities 21 are arranged transversely at upper and lower stages in the housing 20, and are configured for receiving the terminal fittings 10 from behind. Partition walls 22 partition the cavities 21 that are vertically adjacent to each other. The partition walls 22 define the bottom walls of the upper cavities 21 and the upper walls of the lower cavities 21. The partition walls 22 and a bottom wall 23 of the housing 20 have locks 28 that are resiliently engageable with the terminal fittings 10 inserted into the respective cavities 21. As shown in FIGS. 2 and 6, a rearwardly open insertion groove 24 is formed at one lateral edge of the bottom surface of each cavity 21 for receiving the stabilizer 16 of the terminal fitting 10. A front wall 25 of each cavity 21 has a forwardly open insertion hole 26, as shown in FIGS. 1 and 5, through which the mating male terminal is insertable.

Figure 3:
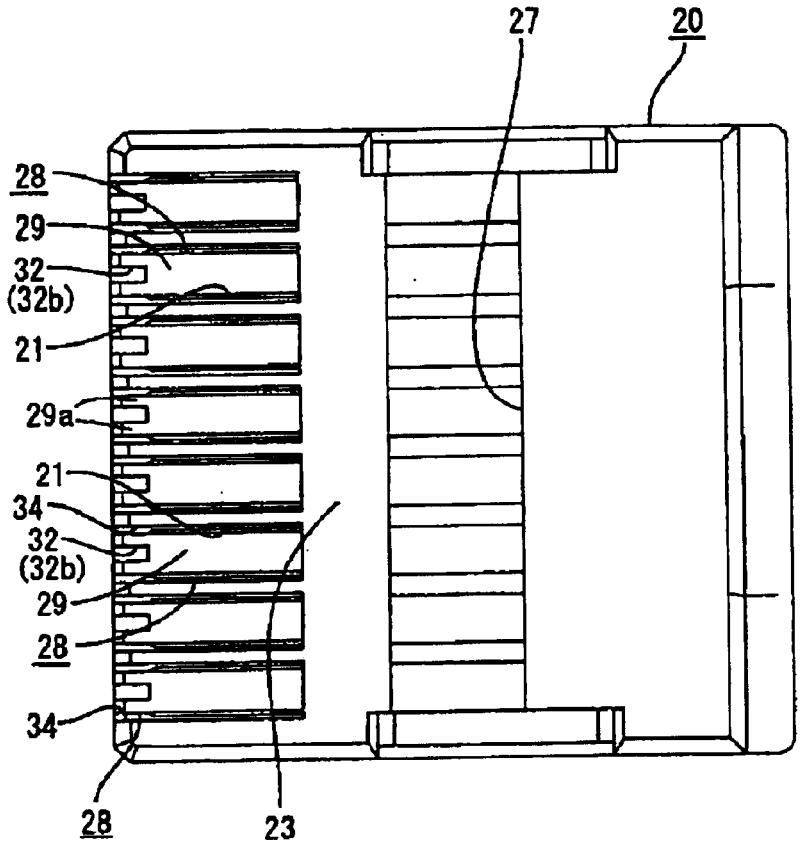
FIG. 3 is a bottom view of the housing.

The bottom wall of the housing 20, as shown in FIGS. 3 and 5, is formed with a retainer mount hole 27 for receiving the retainer 40. The retainer mount hole 27 is substantially at a middle position along the forward and backward directions of the housing 20 and communicates with each cavity 21. Thus, the retainer mount hole 27 divides the partition walls 22 and the bottom wall 23 into front and rear sections. As shown in FIG. 1, the retainer 40 has a lattice-shaped main portion 41 with partition walls 42 at positions corresponding to side walls 21 of the respective cavities 21 of the housing 20. Locking projections 43 project up at positions between the adjacent partition walls 42 of the main portion 41. An insertion recess 44 is at the right side of each locking projection 43 in FIG. 1, and communicates with the corresponding insertion groove 24 of the housing 20 to permit insertion of the stabilizer 16. The retainer 40 can be held in the housing 20 by holding means at a partial locking position (see FIG. 5) where the insertion recesses 44 and the insertion grooves 24 align and where the locking projections 43 are retracted from the cavities 21. The terminal fittings 10 can be inserted and withdrawn along the terminal insertion direction ID into and from the cavities 21 when the retainer 40 is at the partial locking position. The retainer 40 also can be moved to a full locking position (see FIG. 9) where the locking projections 43 project into the cavities 21 to engage the jaws 17.

As shown in FIG. 5, the locks 28 are provided at the bottom surfaces of the corresponding cavities 21 and are formed by cutting portions of the partition walls 22 and the bottom wall 23 before the retainer mount hole 27 into a specified shape. Each lock 28 has an arm 29 supported at the front and rear ends thereof. A locking section 30 is provided on the upper surface of the arm 29 for engaging the engaging portion 15 of the corresponding terminal fitting 10. Thus, the locks 28 are connected at opposite ends with the housing 20 by unitarily forming the locks 28 with the housing 20. Accordingly, the locks 28 are supported at their ends along their longitudinal extension by the housing 20 and are substantially parallel to the terminal insertion direction ID.

Figure 7:
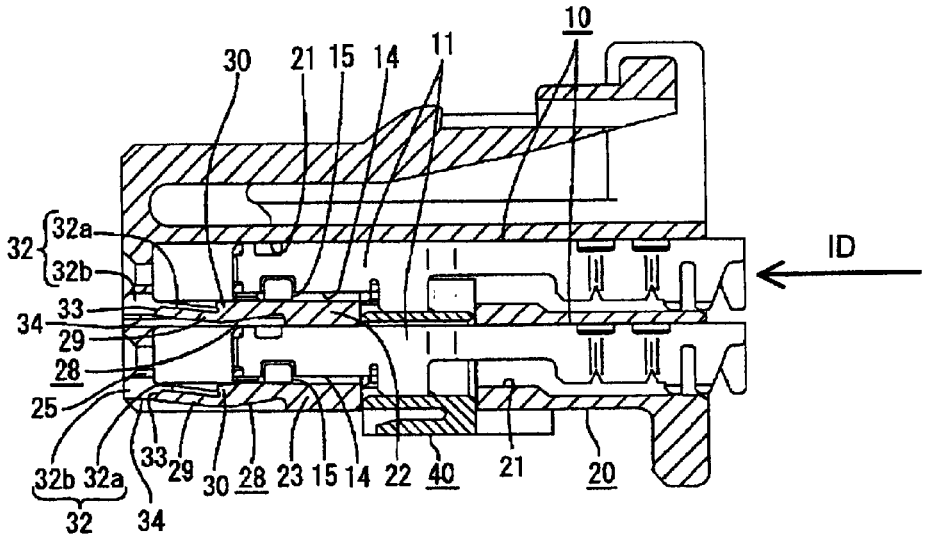
FIG. 7 is a side view in section showing an intermediate stage of insertion of the terminal fitting.

As shown in FIG. 6, each arm 29 extends along the terminal insertion direction ID and has its rear end coupled to the partition wall 22 (bottom wall 23) forward of the insertion groove 24 and has its front end coupled to the front wall 25. Thus, each arm 29 is supported at both front and rear ends to ensure a high strength. The arms 29 are slightly narrower than the cavities 21 and overlap the insertion grooves 24 with respect to widthwise direction, as clearly shown in FIG. 6. The width of the arms 29 is slightly larger than a difference between the width of the cavities 21 and that of the insertion grooves 24. The arms 29 are resiliently deformable relative to the supports at the front and rear ends and can retract into deformation permitting spaces 31 below the arms 29 in a deformation direction. The resiliently deformed arm 29 is arched so that a longitudinal middle portion is lowest, as shown in FIG. 7, and traces of displacement of each section of the arm 29 resulting from the resilient deformation are substantially straight and vertical along a direction substantially normal to the terminal insertion direction ID.

As shown in FIG. 5, each locking section 30 projects into the cavity 21 from the upper surface of the arm 29, and has a height H to engage substantially over the entire length of the engageable portion 15 of the terminal fitting 10. As shown in FIG. 6, each locking section 30 is substantially at a widthwise middle position of the arm 29 and has a length extending from the rear end of the arm 29 substantially to a longitudinal middle position of the arm 29. The front or mating surface of the locking section 30 is engageable with the engaging portion 15 of the terminal fitting 10 and extends substantially normal to the inserting direction ID of the terminal fittings 10. The rear surface of the locking section 30 is slanted and is pushed by the terminal fitting 10 inserted into the cavity 21 to generate resilient deformation of the arm 29. When the arm 29 is deformed by the terminal fitting 10, the upper end of the locking section 30 is displaced to substantially the same height as the bottom surface of the cavity 21 and the middle of the arm 29 along the terminal insertion direction ID is retracted into the deformation permitting space 31 by the height H of the locking section 30. The height of the deformation permitting spaces 31 exceeds the height H of the locking sections 30 so that the arms 29 at the upper stage do not enter the cavities 21 at the lower stage and so that the arms 29 at the lower stage do not project down from the bottom surface of the housing 20.

Figure 10:
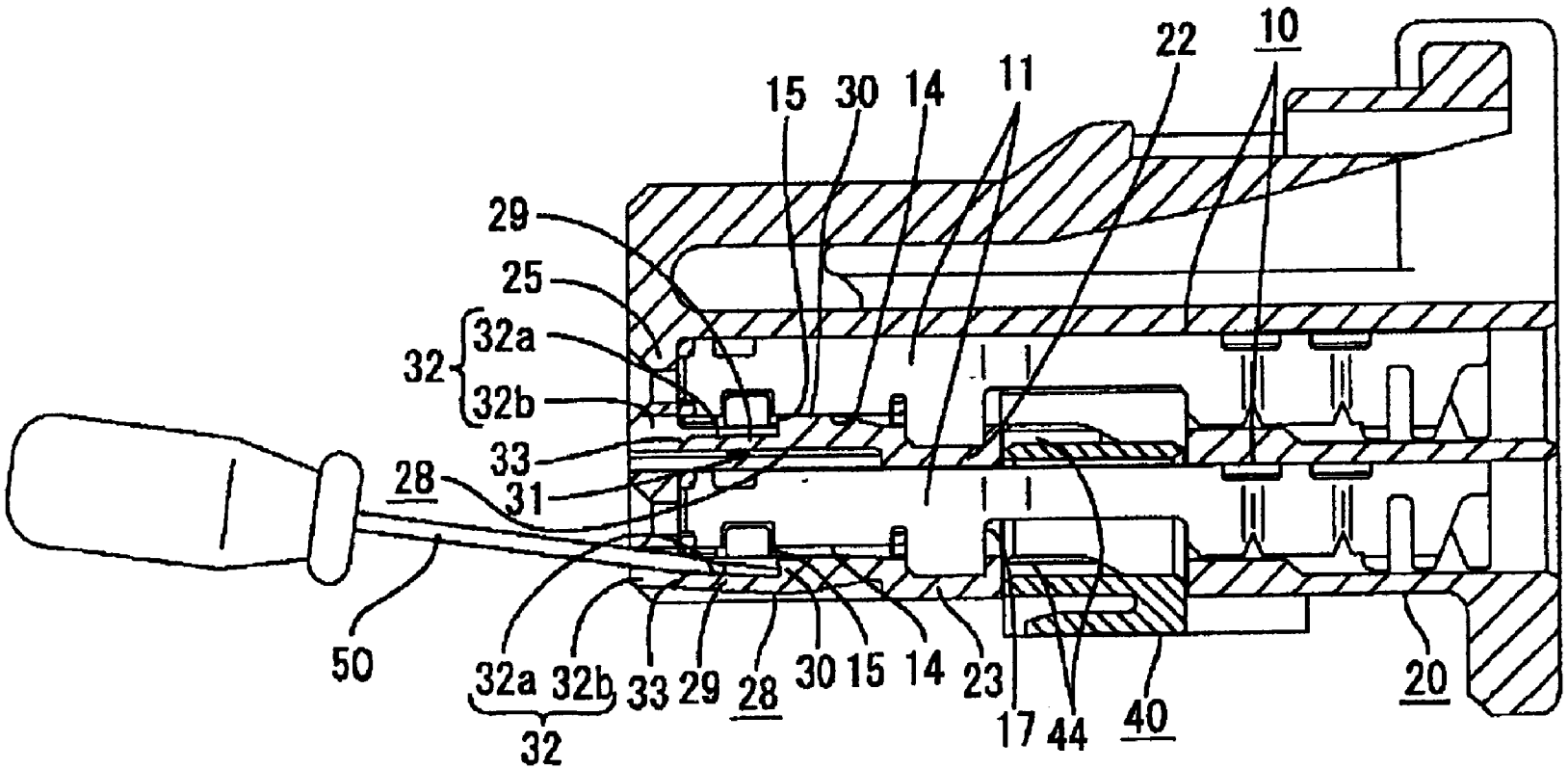
FIG. 10 is a side view in section showing a state where a locking portion is resiliently deformed by an unlocking jig.

A maneuverable recess 32 opens forward from the front end of the locking section 30 at the widthwise middle of the arm 29, as shown in FIGS. 5 and 6. The maneuverable recess 32 has a rear area 32*a* extending from the front end of the locking section 30 to the front end of the cavity 21 and defines a groove with a depth slightly over ⅓ of the thickness of the arm 29. A front area 32*b* of the maneuverable recess 32 forms a fork 29*a* coupled unitarily with opposite widthwise ends of the front wall 25 at opposite sides of the maneuverable recess 32, as shown in FIGS. 1 and 3. As shown in FIG. 10, an unlocking jig 50 is insertable from outside into the maneuverable recess 32 from the front. The unlocking jig 50 can deform the lock 28 by pushing down towards the deformation permitting space 31 on the outer surface of the rear area 32*a* of the maneuverable recess 32. A slanted guide surface 33 is defined between the front and rear areas 32*a*, 32*b* of the maneuverable recess 32 for guiding the insertion of the unlocking jig 50. The maneuverable recesses 32 are located right below the through holes 26 formed in the front walls 25, and an area of opening thereof is smaller than that of the through holes 26.

The locking section 30 and the maneuverable recess 32 are at substantially the widthwise middle of the arm 29, as shown in FIG. 6, whereas the upper surfaces of the opposite widthwise ends of the arm 29 form the bottom surface of the cavity 21 to support the terminal fitting 10 from below.

As shown in FIG. 5, the terminal fitting 10 is inserted in the terminal insertion direction ID into the corresponding cavity 21 from behind with the retainer 40 at the partial locking position in the housing 20. The stabilizer 16 is guided smoothly in sliding contact with the insertion groove 24 and the insertion recess 44. When the terminal fitting 10 is inserted to specified depth, the bottom of the front end of the main portion 11 engages the rear surface of the locking section 30 of the lock 28. Upon further insertion, the terminal fitting 10 is guided by the slanted surface of the locking section 30 and deforms the arm 29 down into the deformation permitting space 31 as shown in FIG. 7. At this stage, the lock 28 is deformed into an arched shape with the coupled portions at the front and rear ends as supports. A degree of maximum displacement at the longitudinal middle of the lock 28 is substantially equal to the height H of the locking section 30. In this deformation process, the traces of displacement of the respective sections of the locks 28 resulting from the resilient deformation are substantially straight in a vertical direction substantially normal to the terminal insertion direction ID.

Figure 8:
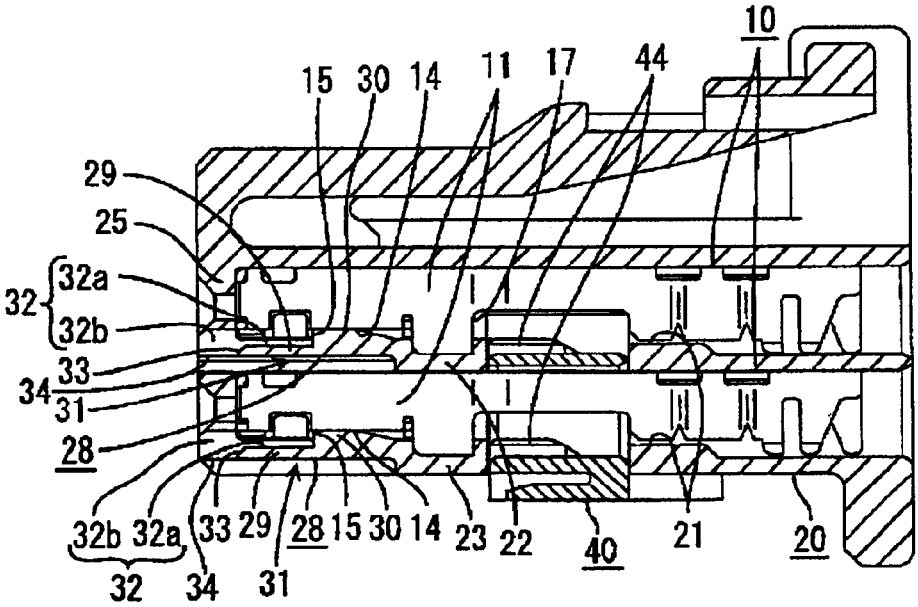
FIG. 8 is a side view in section showing a state where the terminal fittings are inserted to proper depth.

When the terminal fitting 10 is inserted to proper depth, the arm 29 is restored resiliently while the locking section 30 enters the escaping portion 14 of the main portion 11, and the front surface of the locking section 30 engages the engaging edge 15 as shown in FIG. 8. In this way, the terminal fitting 10 is partly locked. At this time, the main portion 11 of the terminal fitting 10 is supported firmly substantially over its entire length by the bottom wall of the cavity 21 and the opposite widthwise ends of the arm 29 of the lock 28.

Figure 9:
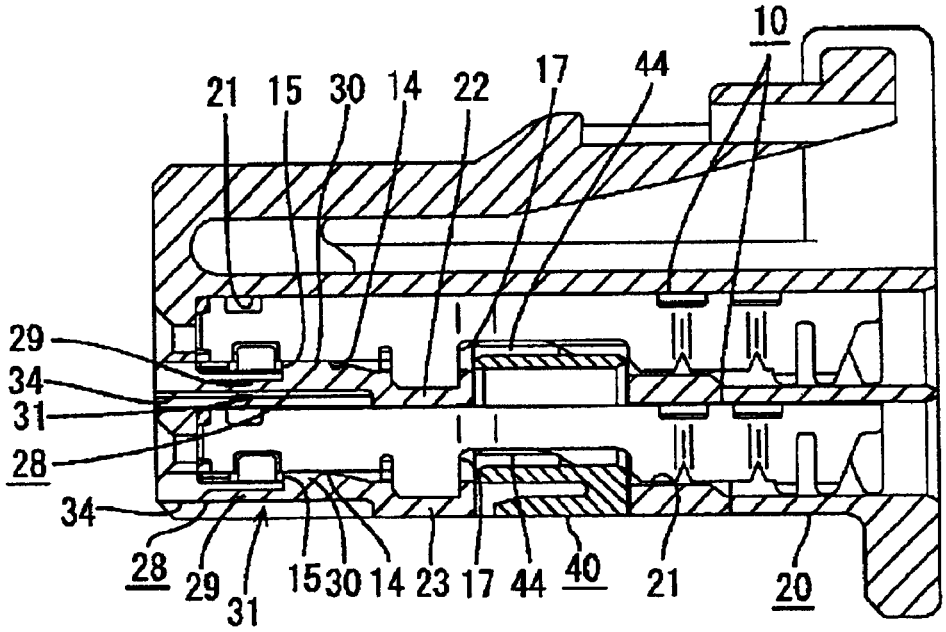
FIG. 9 is a side view in section showing a state reached by moving the retainer to a full locking position.

After all the terminal fittings 10 are inserted into the cavities 21, the retainer 40 is pushed from the partial locking position to the full locking position. Then, as shown in FIG. 9, the locking projections 43 of the retainer 40 engage the jaws 17 of the main portion 11 to fully lock the terminal fittings 10. As a result, the terminal fittings 10 are held so as not to come out of the housing 20.

There are cases where the terminal fitting 10 must be detached from the housing 20 for maintenance or other reason. In such a case, the retainer 40 is returned to the partial locking position and the unlocking jig 50 is inserted into the maneuverable recess 32 in the lock 28 from the front side of the housing 20. The unlocking jig 50 is inserted smoothly between the terminal fitting 10 and the lock 28 by being held in sliding contact with the slanted guide surface 33 of the maneuverable recess 32. When reaching a specified depth of the rear area 32*a* of the maneuverable recess 32, the unlocking jig 50 is pivoted up to push the lock 28 down, as shown in FIG. 10. The terminal fitting 10 can be withdrawn from the cavity 21 while the arm 29 is deformed to disengage the locking section 30 from the engaging edge 15.

Figure 11:
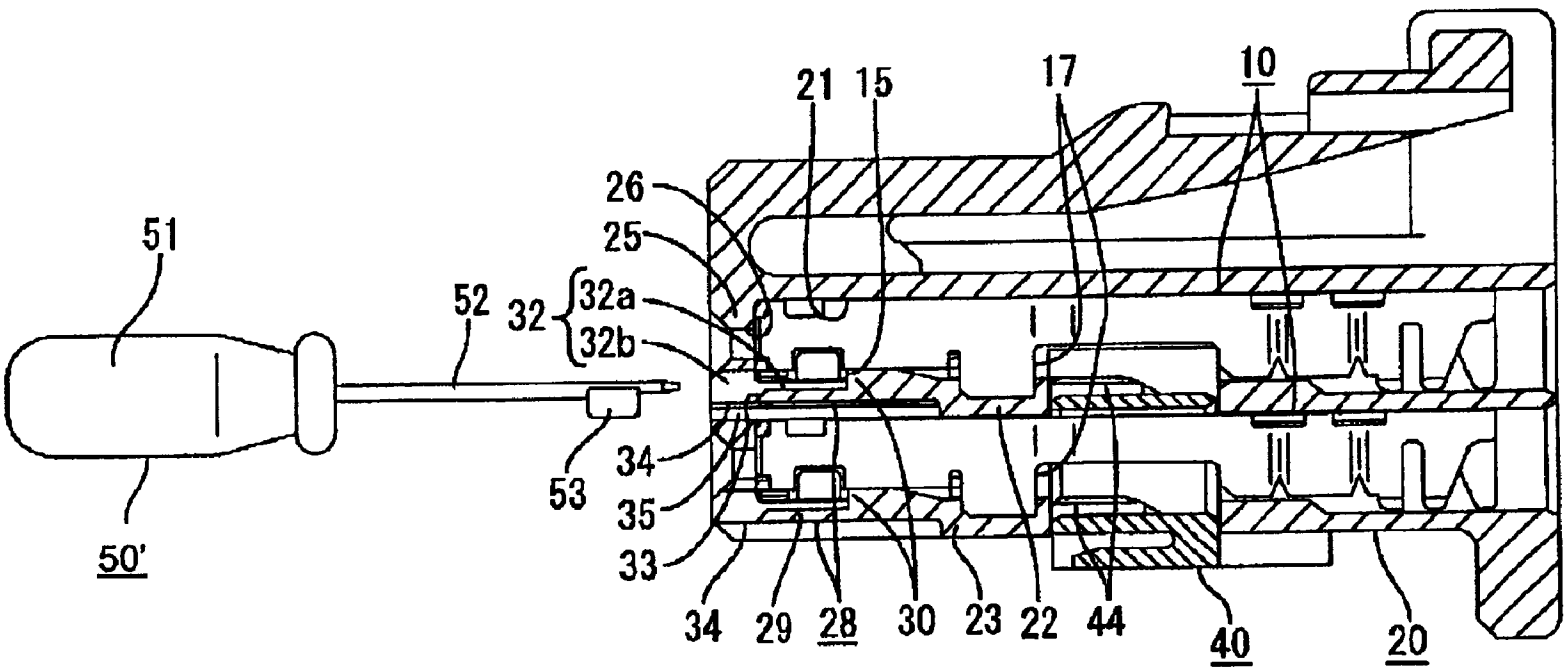
FIG. 11 is a side view in section showing a state before the retainer is moved to a partial locking position and an unlocking jig is inserted.

As described above, the locks 28 are supported at both front and rear ends. Thus, a high strength can be ensured even if the locks 28 are thinned as compared to conventional locks supported only at one end. Accordingly, the connector can be made smaller without degrading the strength of the locks 28. Further, the prior art locks 5 of FIG. 11 trace an arcuate displacement and the deformation permitting spaces 4 need to be sufficiently large to permit the escape of unlocking projections 8 that project forward from the arms 6. However, the locks 28 of the subject invention are supported at both ends, and the deformation permitting spaces 31 can be relatively smaller, which contributes to making the connector smaller.

If an attempt is made to insert the terminal fitting 10 upside down into the cavity 21, the stabilizer 16 contacts an edge of the cavity 21, and insertion of the terminal fitting 10 is prevented. As a result, the terminal fitting 10 that was inserted while being improperly oriented can be detected (see FIG. 5).

As described above, the locks 28 and the insertion grooves 24 are spaced apart from each other in forward and backward directions and overlap with respect to widthwise direction. As a result, the locks 28 are not cut by the insertion grooves 24, as in the prior art, and a large ratio of the width of the locks 28 to that of the cavities can be ensured. Thus, the cavities can be as narrow as possible when the locks are set at a minimum width that ensures sufficient strength. Therefore, the connector can be made smaller.

Each lock 28 is a partition wall 22 between vertically adjacent cavities 21 or a bottom wall 23 at the outside of the housing 20. Thus, the connector can be made smaller. Also, locks 28 supported at both ends can support the terminal fittings 10 in the cavities 21 more firmly than locks supported only at one end. In addition, a lock supported only at one end and serving also as an outer wall or partition wall exposes the terminal fitting 10 because the free end of the lock is separated. The lock 28 supported at both ends offers better protection and a smaller exposed area of the terminal fitting 10.

The maneuverable recess 32 is a recess in the lock 28. Thus, the connector can be made smaller than a case where a maneuverable portion projects from the lock 28.

The fork 29*a* at the front end of the arm 29 makes the lock 28 less rigid. However, the front end of the lock 28 does not contribute to strength for locking the terminal fitting 10. Thus, resistance acting during insertion of the terminal fitting 10 is low while a sufficient force for holding the terminal fittings 10 is ensured.

The fork 29*a* of the arm 29 of the lock 28 is coupled to and supported on the front wall 25 of the cavity 21. Thus, the entire length of the lock 28 can be longer within the same space as compared to a lock supported on a side wall of the cavity 21 and a degree of design freedom of the lock 28 is improved.

A second embodiment of the connector is described with reference to FIGS. 11 to 16. Elements similar to the preceding embodiment are referred to by same reference numerals, and a repeated description is omitted.

Figure 12:
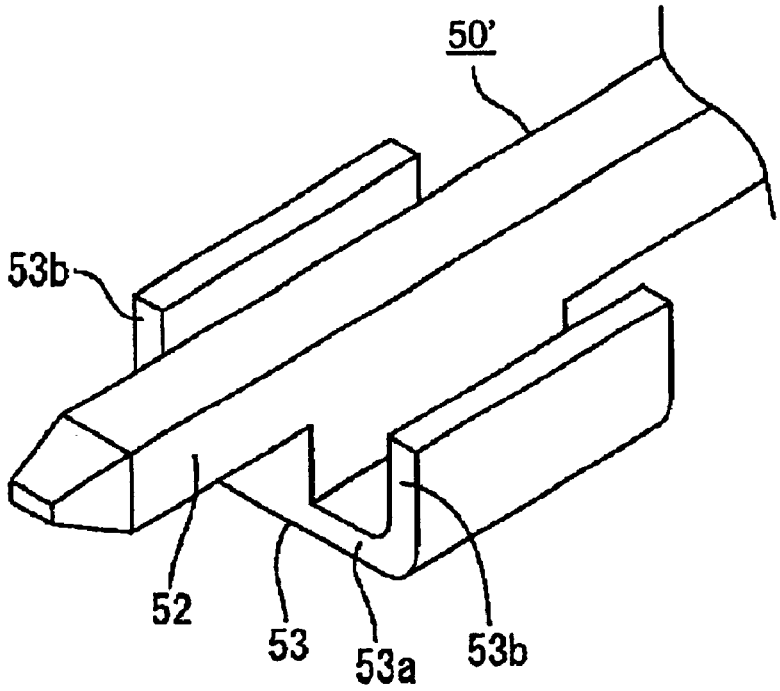
FIG. 12 is an enlarged perspective view of the unlocking jig.
Figure 13:
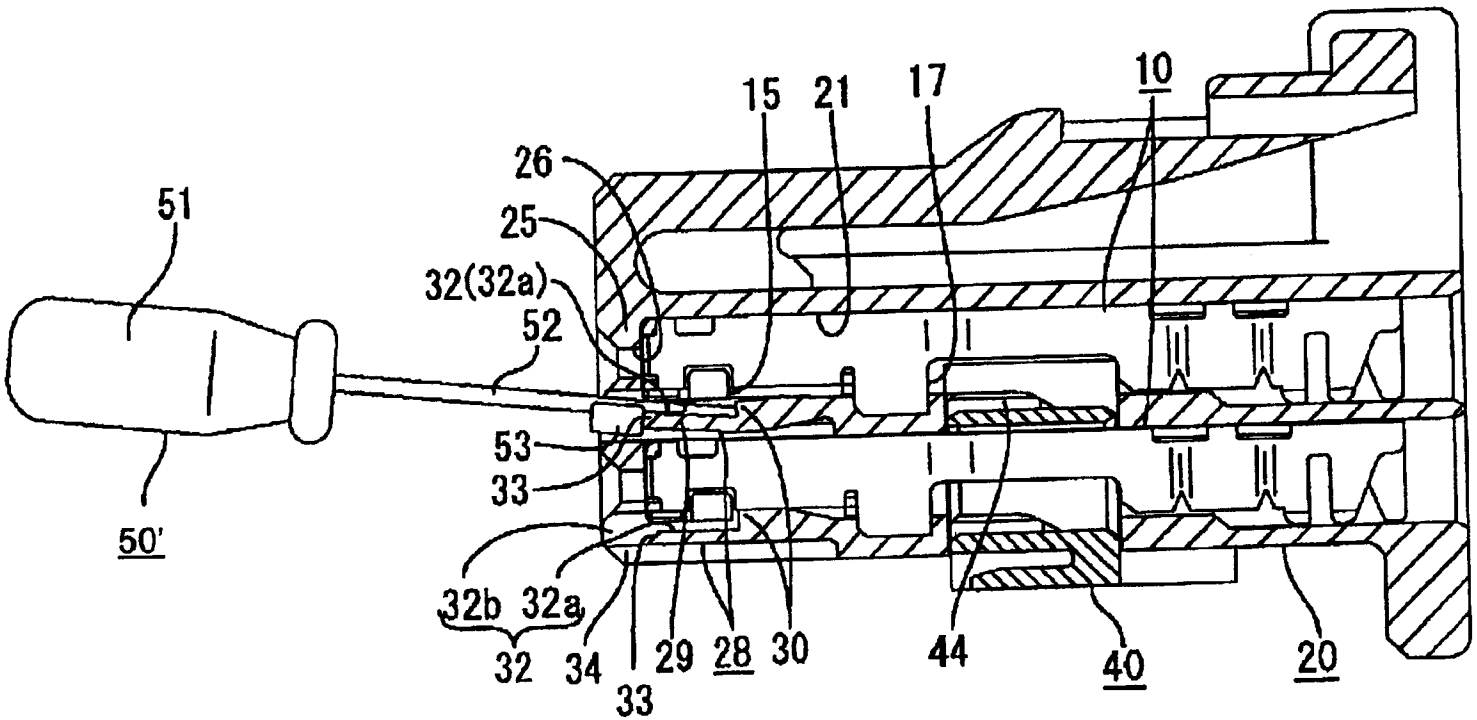
FIG. 13 is a side view in section showing a state where a locking portion is resiliently deformed by an unlocking jig.

A maneuverable recess 32 opens forward at the widthwise middle of the arm 29 in the front end of the locking section 30, as shown in FIGS. 5 and 6. A shaft 52 of an unlocking jig 50' is insertable from outside into the maneuverable recess 32 from the front. As shown in FIG. 12, the shaft 52 of the jig 50' has a substantially rectangular or polygonal cross section and projects forward from a grip 51, and a detector 53 projects from a surrounding surface of a leading end side of the shaft 52.

This maneuverable recess 32 has different heights at its front and rear parts or at longitudinally spaced positions. More particularly, a rear area 32*a* extends from the front end of the locking section 30 to the front end of the cavity 21 and is formed into a groove having a depth of slightly over ⅓ of the thickness of the arm 29. A front area 32*b* of the maneuverable recess 32 is formed into the fork 29*a* the arm 29. Accordingly, the front end of the arm 29 is coupled to the opposite widthwise sides of the front wall 25 at the opposite sides of the maneuverable recess 32, as shown in FIG. 1. The front area 32*b* of the maneuverable recess 32 has a height extending over substantially the entire height of the arm 29 (about twice the thickness of the shaft 52). Thus, the shaft 52 of the unlocking jig 50' can be received loosely. The lock 28 can be deformed by pushing the outer surface of the rear area 32*a* of the maneuverable recess 32 down while inserting the shaft 52 of the unlocking jig 50' to the rear area 32*a*. A slanted guide surface 33 between the front and rear areas 32*a*, 32*b* of the maneuverable recess 32 guides the insertion of the unlocking jig 50 to the back side. The maneuverable recesses 32 are located right below the insertion holes 26 formed in the front wall 25, and an area of opening thereof is smaller than that of the insertion holes 26.

The locking section 30 and the maneuverable recess 32 are at the widthwise middle of the arm 29, as shown in FIG. 6, whereas upper surfaces of the opposite widthwise ends of the arm 29 form the bottom surface of the cavity 21 to support the terminal fitting 10 from below.

Figure 14:
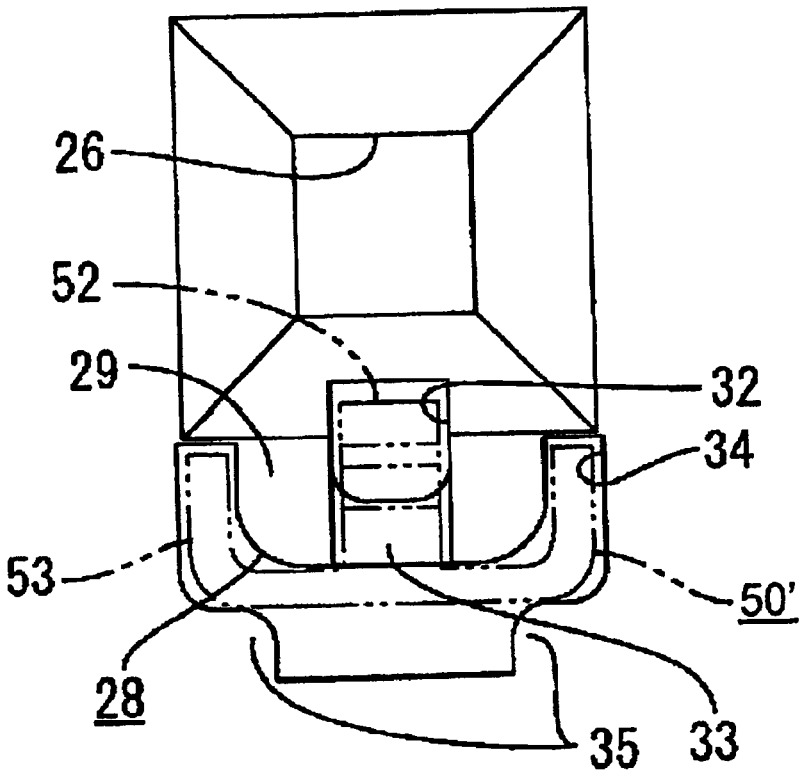
FIG. 14 is an enlarged front view showing a state where a detecting portion is inserted into a receiving portion.

Receiving portions 34 are formed in the front wall 25 of the housing 20 for receiving the detector 53 on the unlocking jig 50', as shown in FIG. 14. Each receiving portion 34 is substantially in the form of a channel surrounding the substantially forked front end of the arm 29, and has a shape conforming to the detector 53. Further, two supports 35 for supporting the inserted detector 53 from below are formed at the opposite lateral edges of the bottom surface of each receiving portion 34 corresponding to the lock 28 at the upper stage.

The detector 53, as shown in FIG. 12, is comprised of an extension 53*a* projecting from the bottom surface of a lateral projection 52*a* of the shaft 52 at a specified distance D from the leading end of the shaft 52 and transversely extending along the widthwise direction substantially normal to the longitudinal direction of the shaft 52. Two projections 53*b* projecting up from the opposite ends of the extension 53*a*. The front end of the detector 53 is behind the front end of the shaft 52 by a distance D slightly less than the thickness of the front wall 25, and the outer width of the detecting portion 53*m*, i.e. the width between the outer surfaces of the projections 53*b*, is larger than the width of the opening of the insertion hole 26. Thus, if an attempt is made to insert the shaft 52 into the insertion hole 26, the detector 53 interferes with the front edge of the insertion hole 26 (see FIGS. 15 and 16).

The second embodiment has substantially the same functions and effects as the first embodiment. However, the differences are described below. In particular, there are cases where the terminal fitting 10 must be detached from the housing 20 for maintenance. In such a case, the retainer 40 is returned to the partial locking position. The leading end of the shaft 52 then is inserted loosely into the front area 32*b* of the maneuverable recess 32 and is moved toward the rear area 32*a*. The shaft 52 is held in sliding contact with the slanted guide surface 33, and hence is inserted smoothly between the terminal fitting 10 and the lock 28. At this time, the insertion of the shaft 52 is permitted by letting the detector 53 enter the receiving portion 34 as shown in FIG. 14. When the leading end of the shaft 52 reaches a specified depth in the rear area 32*a* of the maneuverable recess 32, the unlocking jig 50' is pivoted up to push a peripheral edge of the rear area 32*a* down and to deform the arm 29 of the lock 28, as shown in FIG. 10. The locking section 30 is disengaged from the engaging edge 15 and the terminal fitting 10 is withdrawn from the cavity 21.

Figure 15:
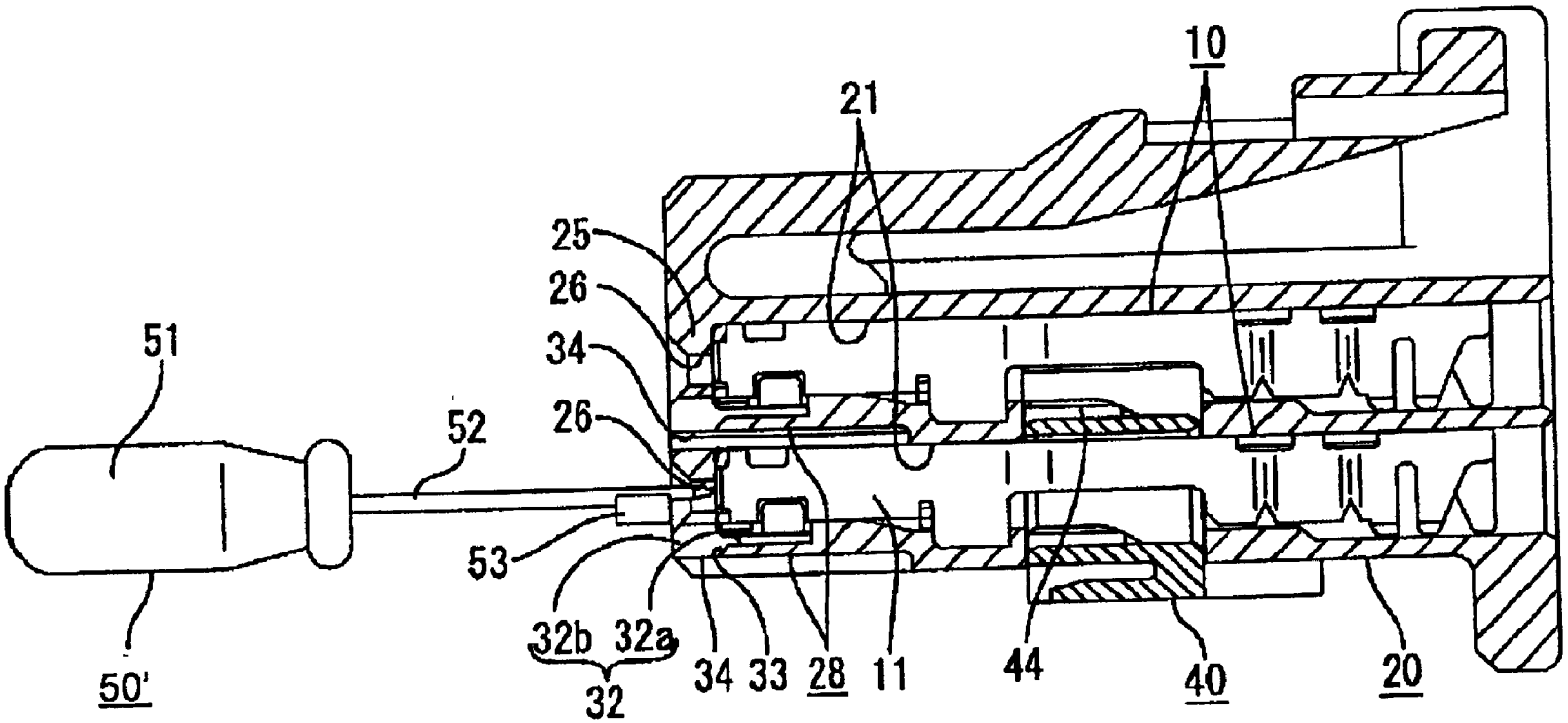
FIG. 15 is a side view in section showing a state where a shaft of the unlocking jig is inserted into an insertion hole.
Figure 16:
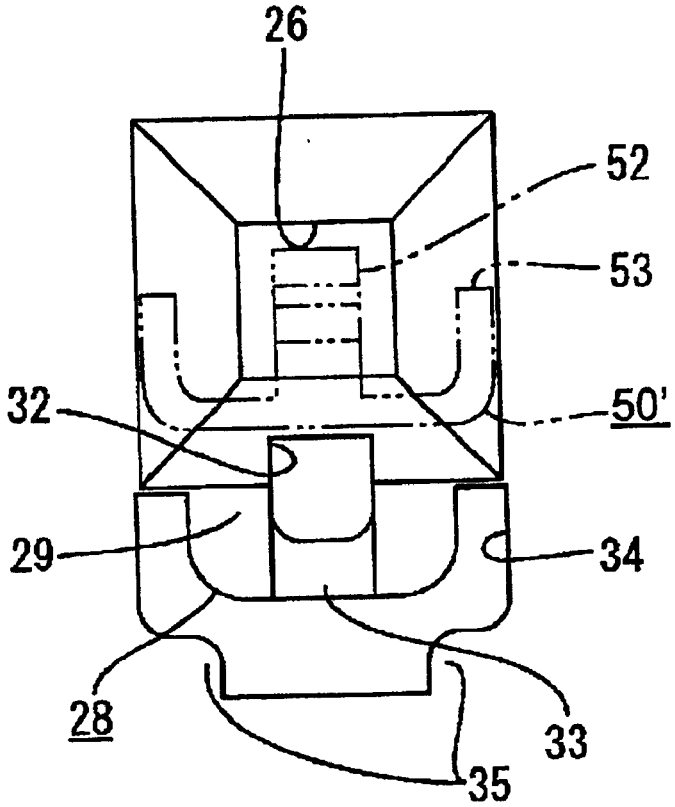
FIG. 16 is an enlarged front view showing a state where the detecting portion is in abutment against an edge of the insertion hole.
Figure 17:
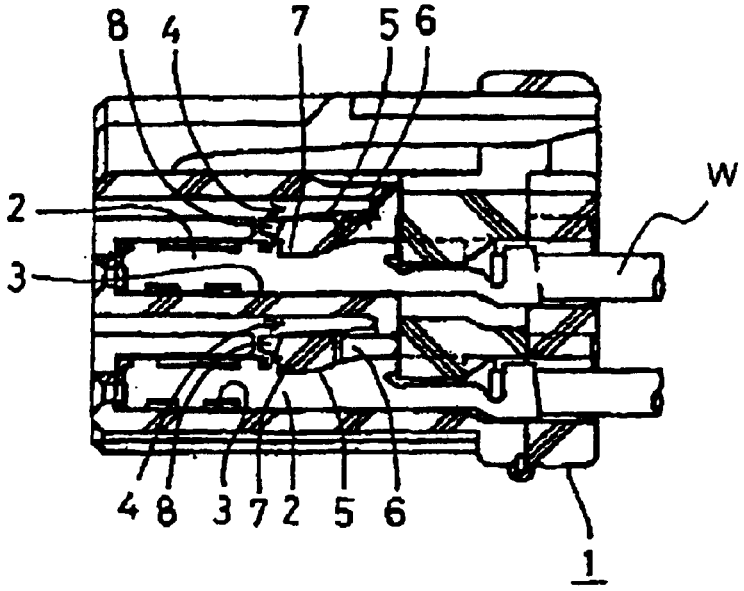
FIG. 17 PRIOR ART
FIG. 17 is a side view in section of a prior art connector.
Figure 18:
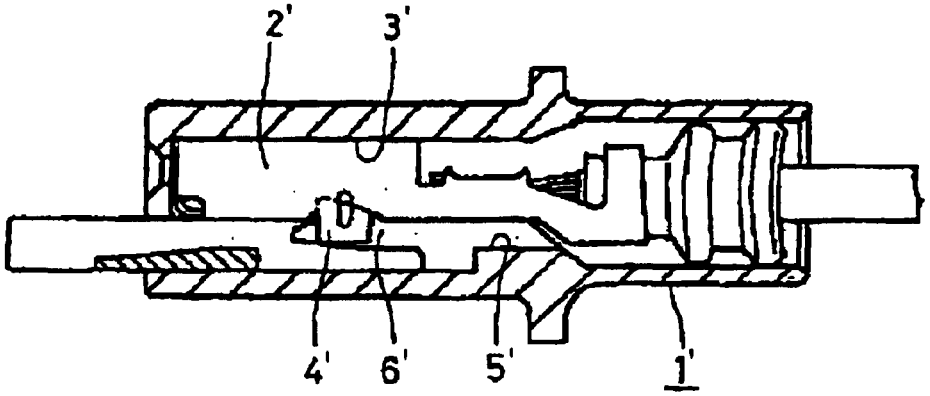
FIG. 18 PRIOR ART
FIG. 18 is a side view in section of a prior art connector.

An operator may mistakenly insert the shaft 52 into the insertion hole 26 because the insertion holes 26 are formed in the front wall 25 of the housing 20 right above the maneuverable recesses 32. In such a case, when the shaft 52 is inserted to specified depth in the insertion hole 26, as shown in FIG. 15, the detector 53 contacts the front edge of the insertion hole 26 as shown in FIG. 16, and prevents any further insertion of the shaft 52. Since the leading end of the shaft 52 is left in the insertion hole 26 without entering the cavity 21, the shaft 52 does not interfere with the terminal fitting 10. By hindering the insertion of the unlocking jig 50', an erroneous insertion of the unlocking jig 50' can be detected by the operator.

As described above, the locks 28 are supported at both front and rear ends, and a high strength can be ensured even if the locks 28 are thinned as compared to conventional ones supported only at one end.

Furthermore, since the maneuverable recess 32 is formed by recessing the lock 28, the connector can be made smaller, as compared to a case where a maneuverable portion projects from the lock 28.

Further, the shaft 52 of the unlocking jig 50' is inserted loosely into the front area 32*b* of the maneuverable recess 32. Thus, operability at the initial state of the insertion of the unlocking jig 50' is good. In the process of inserting the shaft 52 inserted into the front area 32*b* of the maneuverable recess 32 to the rear area 32*a*, the shaft 52 can be guided smoothly to the back side by the guide surface 33 and can push the peripheral edge of the rear area 32*a* and, therefore, operability is satisfactory. Further, since the lock 28 has the fork 29*a* at the front area 32*b* of the maneuverable recess 32, a maximum opening area can be ensured in relation to the thickness of the lock 28. Therefore, the shaft 52 of the unlocking jig 50' can be received more easily.

The unlocking jig 50' has the detector 53 and the housing 20 has the receiving portions 34 for receiving the detector 53. Thus, the insertion of the unlocking jig 50' to the back side is permitted when the shaft 52 of the unlocking jig 50' is inserted into the maneuverable recess 32. However, the detector 53 contacts the front edge of the insertion hole 26 to prevent any further insertion of the shaft 52 into the insertion hole 26 and to detect an erroneous insertion of the unlocking jig 50'. Therefore, operability of detaching the terminal fitting 10 with the unlocking jig 50' is improved.

The present invention is not limited to the above described and illustrated embodiment. For example, following embodiments are also embraced by the technical scope of the present invention as defined by the claims. Beside the following embodiments, various changes can be made without departing from the scope and spirit of the present invention as defined by the claims.

The locks are supported at both front and rear ends in the foregoing embodiment. However, locks extending in widthwise direction and supported at the opposite widthwise ends also are embraced by the present invention.

Although the locks are at the bottom surfaces of the cavities in the foregoing embodiment, they may be provided, for example, at upper surfaces or side surfaces of the cavities according to the present invention.

Although the locks also serve as the partition walls between adjacent cavities and the bottom outer wall of the housing in the foregoing embodiment, the partition walls and the outer wall may be separate from the locks.

Although the locks are recessed to form the maneuverable recesses in the foregoing embodiment, maneuverable portions may be provided to project from the outer surfaces of the locks according to the present invention.

Although the connector having the cavities at two stages is described in the foregoing embodiment, connectors having cavities at three or more stages or only one stage also are embraced by the present invention.

Although the female connector having the terminal fittings of the insulation-displacement type is described in the foregoing embodiment, the terminal fittings may be of the type to be crimped into connection with cores of wires and the connector may be a male connector.

Although the locking is forked by the front area of the maneuverable recess in the foregoing embodiment, it may not be necessarily forked provided that the front area of the maneuverable recess has a size sufficient to loosely insert the shaft of the unlocking jig.

Although the detector interferes with the edge of the insertion hole by setting the outer width of the detector larger than the width of the openings of the insertion holes in the foregoing embodiment, the detector may be caused to interfere with the edge of the insertion hole, for example, by setting unmatching shapes for the detector and the insertion hole although they may have the same size. Such an embodiment is also embraced by the present invention.

Although the locks are supported at both ends in the respective embodiments described above, certain aspects of the invention are applicable to locks supported only at one end as shown as the prior art.

What is claimed is:

1. A connector comprising a housing with opposite front and rear ends, at least one cavity extending through the housing from the front end to the rear end and into which at least one terminal fitting is insertable, a lock provided on an inner surface of the cavity for resiliently locking the inserted terminal fittings, the lock being supported at opposite ends thereof, at least one of the ends of the lock defining a fork coupled to the housing at first and second spaced apart supports.

2. The connector of claim 1, wherein the lock defines an outer wall of the housing.

3. The connector of claim 1, wherein the lock comprises a maneuverable recess maneuverable by an unlocking jig from outside, the maneuverable recess extending into the cavity from the front end of the housing at a location between the first and second supports for the fork.

4. The connector of claim 1, wherein the lock is substantially parallel with a terminal insertion direction of the terminal fitting into the cavity.

5. The connector of claim 4, wherein the lock comprises a locking section for engaging the terminal fitting, wherein the lock is displaced by a distance substantially corresponding to a projecting distance of the locking section.

6. The connector of claim 5, wherein the terminal fitting has a length and the lock is formed such that the terminal fitting substantially contacts the housing over substantially the entire length of the terminal fitting inserted into the cavity.

7. The connector of claim 1, wherein the at least one cavity comprises a plurality of cavities, each said cavity having one said lock, each said lock comprises a maneuverable recess maneuverable by a jig from outside.

8. The connector of claim 7, wherein first and second supports of the fork of each said lock are coupled to a front wall at the front end of the housing, each said maneuverable recess being open forwardly through the front wall and between the first and second supports, an opening of the maneuverable recess forming an introduction opening into which the jig is loosely insertable for engaging portions of the lock rearwardly from the first and second supports.

9. The connector of claim 8, wherein a guide surface for guiding the jig toward a back side of the maneuverable recess is formed at a back edge of the introduction opening.

10. The connector of claim 7, wherein: the maneuverable recess and at least one insertion hole for permitting insertion of mating terminal fittings into the corresponding cavity are formed in a front wall of the housing; and the jig is configured to prevent insertion of the jig into the insertion hole.

11. The connector of claim 1, wherein the lock comprises a locking section for engaging the terminal fitting, the locking section being aligned between the first and second supports.

12. A connector comprising a housing with opposite front and rear ends, a front wall at the front end, at least one cavity extending from the rear end of the housing to the front wall, at least one insertion hole extending through the front wall and communicating with the cavity, a resiliently deflectable lock formed unitarily with the housing and disposed in the cavity, the lock having first and second spaced apart front supports coupled unitarily to the housing substantially at the front wall and a rear support joined unitarily to the housing at a location between the front wall of the housing and the rear end of the housing.

13. The connector of claim 12, further comprising a maneuverable recess extending through the front wall of the housing and communicating with the cavity at a location between the first and second supports of the lock.

14. The connector of claim 13, wherein the lock includes a locking section projecting from the lock and into the cavity at a location rearward from the first and second supports.

15. The connector of claim 13, wherein the maneuverable recess extends through the front wall of the housing at a location spaced from the insertion hole.

16. The connector of claim 15, wherein the maneuverable recess is cross-sectionally smaller than the insertion hole.

17. The connector of claim 12, wherein the rear end of the lock is joined unitarily to the housing at only one rear support.

18. A connector comprising a housing with opposite front and rear ends, a front wall at the front end, cavities extending from the rear end of the housing to the front wall and insertion holes extending through the front wall and communicating respectively with the cavities, resiliently deflectable locks formed unitarily with the housing and disposed in the respective cavities, each said lock having first and second spaced apart front supports joined unitarily to the housings and a rear support joined unitarily to the housing at a location rearwardly of the front support.

19. The connector of claim 18, wherein the first and second spaced apart front supports of each said lock are coupled unitarily to the housing substantially at the front wall of the housing.

20. The connector of claim wherein the front wall of the housing further includes a plurality of maneuverable recesses extending therethrough and communicating respectively with spaces defined between the first and second spaced apart front supports of each respective lock.

21. The connector of claim wherein each said maneuverable recess is cross-sectionally smaller than the corresponding insertion hole.

22. The connector of claim 21, wherein the maneuverable recess for each said lock is spaced from the insertion hole that communicates with the cavity in which the respective lock is disposed.

23. The connector of claim 18, wherein at least one said locks in said housing is disposed to define a wall between two of said cavities in said housing.

24. The connector of claim 23, wherein at least one said lock is disposed in said cavity to define an external wall of said housing.

25. The connector of claim 18, wherein each said lock includes a locking section spaced rearwardly from said first and second support and projecting into the respective cavity.

26. The connector of claim 18, wherein each said lock has a longitudinal direction extending substantially along a line from the rear end of the housing towards the front end of the housing, each said lock being resiliently deflectable in a deflection direction substantially normal to the longitudinal direction of the lock, the first and second front supports being spaced apart from one another in a direction transverse to the deflection direction of the lock and transverse to the longitudinal direction of the lock.

* * * * *